US007979935B2

(12) United States Patent
Grothaus

(10) Patent No.: US 7,979,935 B2
(45) Date of Patent: Jul. 19, 2011

(54) INNERSPRING ASSEMBLY WITH EDGE REINFORCEMENT

(75) Inventor: Wolfgang Grothaus, Bad Essen (DE)

(73) Assignee: AGRO Holding GmbH, Bad Essen (DE)

( * ) Notice: Subject to any disclaimer, the term of this patent is extended or adjusted under 35 U.S.C. 154(b) by 66 days.

(21) Appl. No.: 12/469,274

(22) Filed: May 20, 2009

(65) Prior Publication Data

US 2009/0288258 A1 Nov. 26, 2009

(30) Foreign Application Priority Data

May 21, 2008 (DE) ..... 10 2008 024 529

(51) Int. Cl.

| | |
|---|---|
| ***A47C 23/04*** | (2006.01) |
| ***A47C 23/053*** | (2006.01) |
| ***A47C 27/07*** | (2006.01) |
| ***F16F 3/00*** | (2006.01) |

(52) U.S. Cl. ..... 5/717; 5/720; 5/655.8; 267/93

(58) Field of Classification Search ..... 5/717, 720, 5/716, 655.7, 655.8; 267/93

See application file for complete search history.

(56) References Cited

U.S. PATENT DOCUMENTS

| | | | | |
|---|---|---|---|---|
| 698,529 | A * | 4/1902 | Marshall | 5/720 |
| 1,741,847 | A * | 12/1929 | Kaspar | 5/655.8 |
| 2,320,153 | A * | 5/1943 | Moske | 267/93 |
| 2,568,055 | A * | 9/1951 | Clark | 267/93 |
| 3,230,558 | A * | 1/1966 | Duncan | 5/720 |
| 6,154,908 | A * | 12/2000 | Wells | 5/720 |
| 6,158,071 | A * | 12/2000 | Wells | 5/717 |
| 6,202,238 | B1 * | 3/2001 | Mossbeck et al. | 5/717 |
| 6,295,676 | B1 * | 10/2001 | Warner | 5/720 |
| 6,398,199 | B1 * | 6/2002 | Barber | 267/93 |
| 6,540,214 | B2 * | 4/2003 | Barber | 267/93 |
| 6,898,813 | B2 * | 5/2005 | Grothaus | 5/655.8 |
| 6,966,091 | B2 * | 11/2005 | Barber | 5/716 |
| 2003/0074736 | A1 | 4/2003 | Grothaus | 5/655.8 |
| 2004/0128773 | A1 * | 7/2004 | Barber | 5/716 |
| 2009/0288258 | A1 * | 11/2009 | Grothaus | 5/717 |
| 2011/0041252 | A1 * | 2/2011 | DeFranks et al. | 5/655.8 |

FOREIGN PATENT DOCUMENTS

| | | |
|---|---|---|
| CA | 2 234 839 A1 | 10/1999 |
| DE | 1 654 319 | 2/1971 |
| DE | 40 31 654 A1 | 4/1992 |
| DE | 297 22 598 U1 | 2/1998 |
| GB | 2 403 902 A | 1/2005 |
| WO | WO 2007/013855 | 2/2007 |

* cited by examiner

*Primary Examiner* — Robert G Santos

(74) *Attorney, Agent, or Firm* — Henry M. Feiereisen; Ursula B. Day

(57) ABSTRACT

An innerspring assembly includes a plurality of first springs arranged side-by-side in axis-parallel relationship and wound in the form of a helix. Several first springs which are arranged behind one another in a row define a spring strand. An edge reinforcement is formed by second springs placed on at least two opposite borders of the innerspring assembly, with each second spring being connected with two first springs of an adjacent spring strand.

9 Claims, 2 Drawing Sheets

INNERSPRING ASSEMBLY WITH EDGE REINFORCEMENT

CROSS-REFERENCES TO RELATED APPLICATIONS

This application claims the priority of German Patent Application, Serial No. 10 2008 024 529.1, filed May 21, 2008, pursuant to 35 U.S.C. 119(a)-(d), the content of which is incorporated herein by reference in its entirety as if fully set forth herein.

BACKGROUND OF THE INVENTION

The present invention relates to an innerspring assembly with edge reinforcement.

The following discussion of related art is provided to assist the reader in understanding the advantages of the invention, and is not to be construed as an admission that this related art is prior art to this invention.

Innerspring assemblies are widely used, primarily for manufacture of mattresses or upholstered furniture. To achieve edge stability, especially when the upholstery or the mattress is used as seat, it has been proposed to provide the innerspring assembly on the topside and bottom side with an edge reinforcement made of round or flat material, such as metal. An example of an innerspring assembly of this type is described in German patent document DE 16 54 319 A1. This type of innerspring assembly suffers shortcomings because it cannot be rolled up or unrolled. This capability is however important to complete the end product, such as mattress or upholstery, as in most cases the innerspring assembly has to be transported from the manufacturing site to the mattress fabrication site, whereby the production site for the end product and the manufacturing site for the innerspring assembly are typically far apart in distance.

By nature, innerspring assemblies are very voluminous while their weight is small, rendering the transport costs of innersprings very high. To reduce costs, it has been suggested to make the edge reinforcement of sheet metal strips so that the innerspring assembly can be rolled up for transport. Providing the innerspring assembly with such a metal frame is however very labor-intensive and costly so that any saving in transport is negated by the increase in labor and costs. This is problematic, considering that innersprings are produced on a large scale.

It would therefore be desirable and advantageous to provide an improved innerspring assembly which obviates prior art shortcomings and which is easy and cost-effectively to produce while yet allowing easy transport.

SUMMARY OF THE INVENTION

According to one aspect of the present invention, an innerspring assembly includes a plurality of first springs arranged side-by-side in parallel relationship and wound in the form of a helix, wherein several springs arranged behind one another in a row define a spring strand, and an edge reinforcement formed by second springs placed on at least two opposite borders of the innerspring assembly, each second spring being connected with two first springs of an adjacent spring strand.

An innerspring assembly according to the present invention is easy to manufacture, i.e. less labor-intensive than heretofore, so that production costs can be significantly reduced. Yet, the desired function of the edge reinforcement remains fully intact, especially the required stiffness of the border region, as demanded from seat upholstery of a seating furniture, so that a user is able to get out from the seating furniture more comfortably. The edge reinforcement forms hereby an abutment for support of the resting thigh of the user whereas the actual seating area provides the desired comfort. This benefit is attained also for mattresses because the edge reinforcement ensures a more comfortable use of the mattress when getting in or out from a reclining furniture.

According to another advantageous feature of the present invention, the second springs define outer springs to form the borders of the innerspring assembly and can be placed in a gap between two first springs of the adjacent spring strand. The gap is hereby formed by a spaced-apart disposition of the two first springs of the adjacent spring strand. This type of nest formation leads to enhanced dimensional stability.

The spring behavior of the edge formation can be influenced by modifying wire gauge, spring shape, number of windings, or material selection. Suitably, the wire gauge of the second springs is greater than a wire gauge of the first springs. The same holds true for other parameters, leading to a greater stiffness of the second springs compared to the stiffness of the first springs.

According to another advantageous feature of the present invention, the first and second springs can be received in pockets of flexible material, e.g. textile material. The second springs, which form the border-side spring strands, or their enveloping pockets are hereby connected with two first springs of the adjacent spring strand to ensure a firm bond between both spring strands. Currently preferred is a gluing of the second springs with the adjacent spring strand of first springs.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
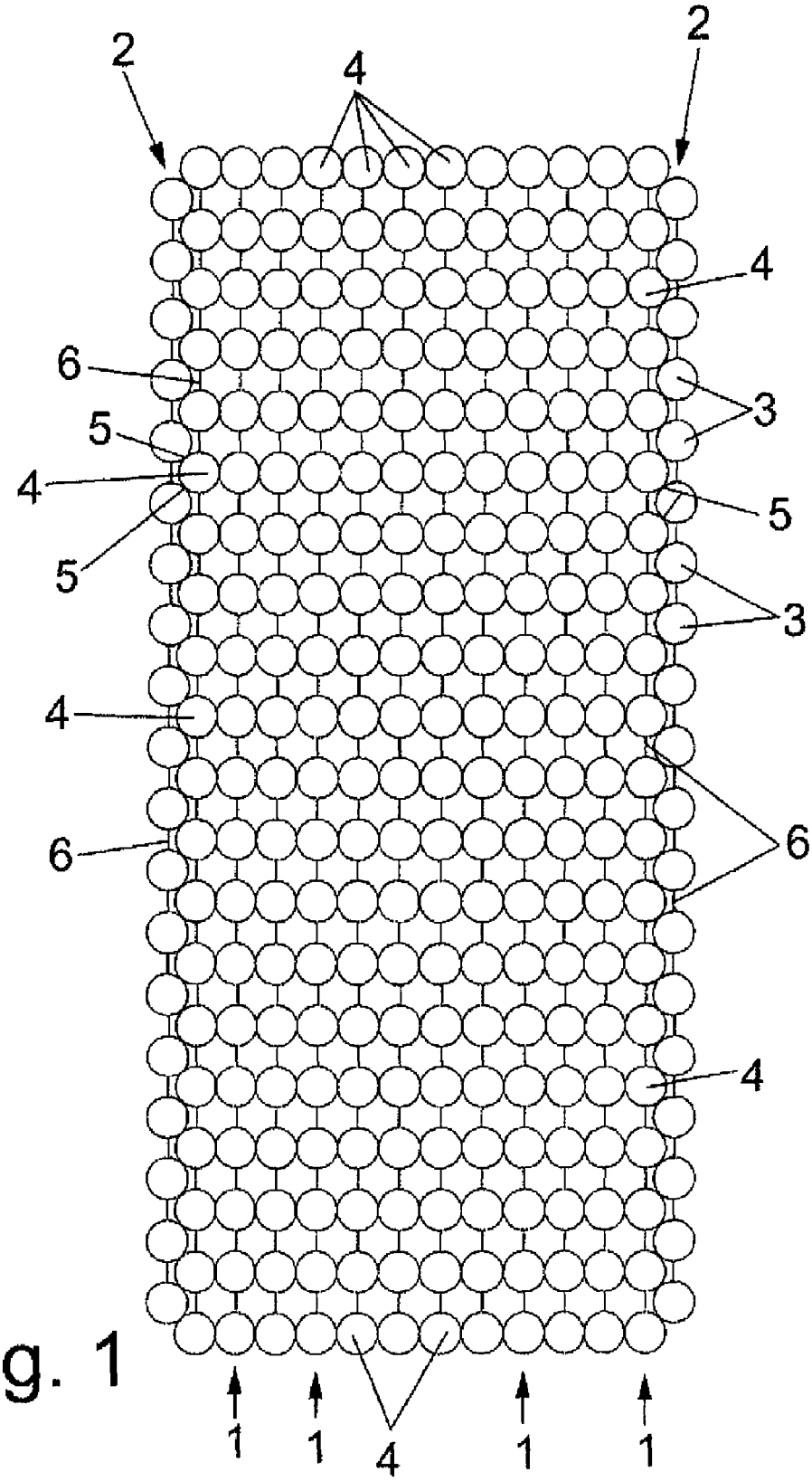
FIG. 1 is a schematic top view of one embodiment of an innerspring assembly according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic top view of one embodiment of an innerspring assembly according to the present invention, including a plurality of helically wound springs 3, 4 which are arranged axis-parallel in side-by-side disposition. Springs 3, 4 arranged behind one another in a row form a spring strand 1, 2, respectively. The springs 3 are hereby arranged on at least two opposite borders of the innerspring assembly, with each of the springs 3 being connected with two springs 4 of the adjacent spring strand 1.

Figure 2:
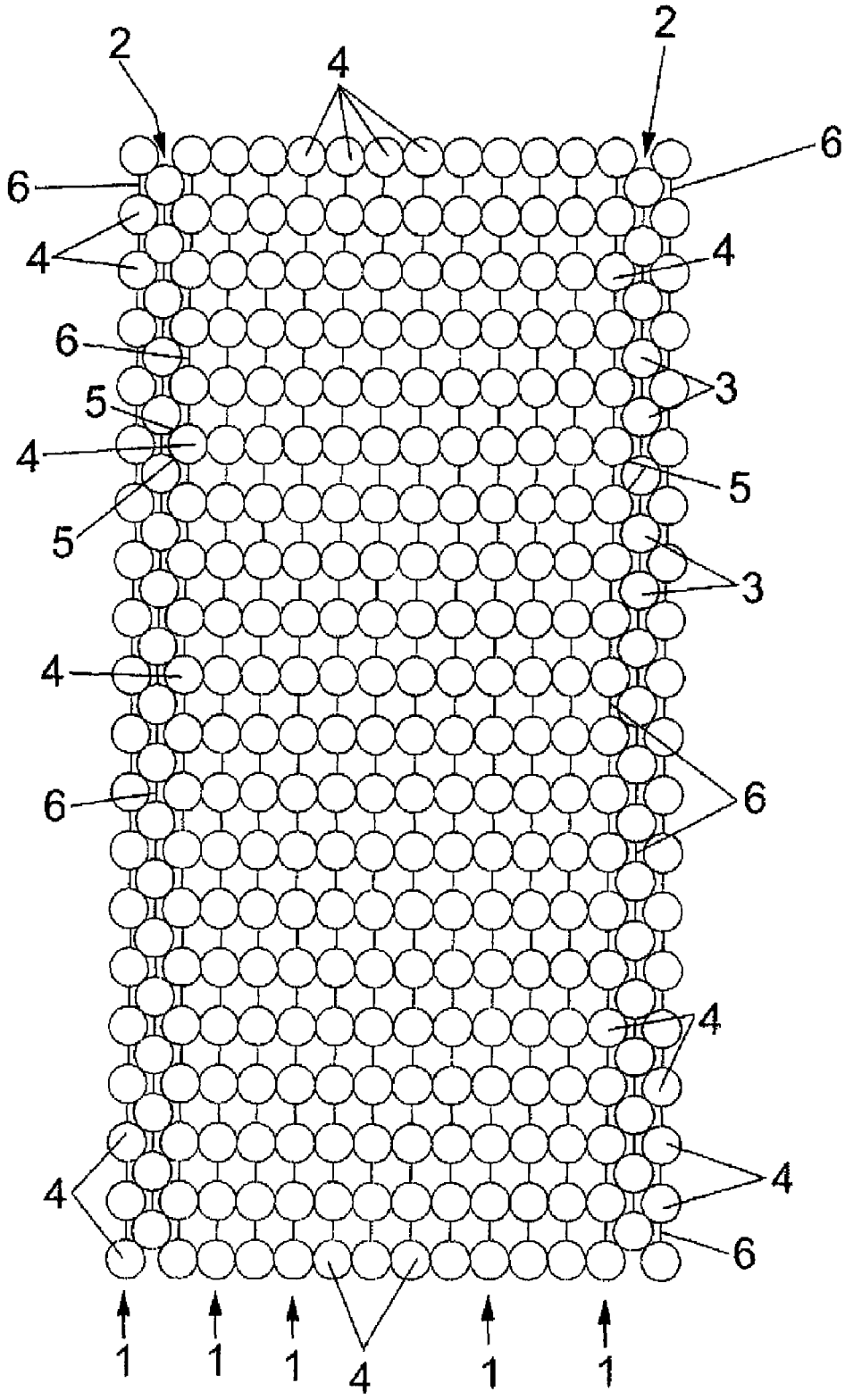
FIG. 2 is a schematic top view of another embodiment of an innerspring assembly according to the present invention.

In the non-limiting examples shown in FIGS. 1 and 2, the inner spring assembly is constructed in the form of a pocketed innerspring assembly in which each of the springs 3, 4 is received in a pocket made of flexible material, e.g. textile material. The pockets are interconnected by bridges 6 to maintain the pockets and thus the springs 3, 4 in spaced-apart relationship.

The springs 3 along the borders of the innerspring assembly jointly form the spring strand 2 which also has bridges 6 defined by a length which corresponds to the length of the bridges 6 of the spring strands 1.

As shown in FIG. 1, the springs 3 of the innerspring assembly which define the outer spring strands 2 are placed in the gaps, formed by the bridges 6, between two associated springs 4 of the adjacent spring strand 1 and connected, e.g. by means of a glueline 5, with the contacting pockets of the thereby enveloped springs 4. As a result, a zigzag union is established between the two outer spring strands 1, 2 to form an edge reinforcement.

FIG. 2 shows is a schematic top view of another embodiment of an innerspring assembly according to the present invention. Parts corresponding with those in FIG. 1 are denoted by identical reference numerals and not explained again. The description below will center on the differences between the embodiments. In this embodiment, the spring strands 2 are arranged at the borders between two identical spring strands 1 of which one defines the outer spring strand, whereas each of the springs 3 of the interposed spring strand 2 is connected to two springs 4 of the inner one of the two spring strands 1 as well as with two springs 4 of the outer one of the spring strands 1 which defines the border. The springs 3, 4 are also pocketed to define the spring strands 1, 2 respectively, in longitudinal direction. The interposed spring strand 2 has a length which is shorter than a length of the spring strands 1.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed is:

1. An innerspring assembly, comprising:

a plurality of first springs wound in the form of a helix wherein several first springs arranged behind one another in a spaced-apart relationship define a spring strand and several spring strands arranged side-by-side form parallel rows of first springs in contiguous relationship such as to define gaps which continuously extend from one border of the assembly to another opposite border of the assembly; and an edge reinforcement formed by second springs placed on said two opposite borders of the innerspring assembly, each said second spring being connected with two first springs of an adjacent spring strand and placed in the gap between the two first springs.

2. The innerspring assembly of claim 1, wherein the second springs define outer springs to form the borders of the innerspring assembly.

3. The innerspring assembly of claim 1, wherein the second springs form a spring strand.

4. The innerspring assembly of claim 1, wherein the second springs have a spring stiffness which is greater than a spring stiffness of the first springs.

5. The innerspring assembly of claim 1, wherein the first and second springs have a characteristic selected from the group consisting of wire gauge, shape, and material composition, wherein the characteristic of the second springs is different than the characteristic of the first springs.

6. The innerspring assembly of claim 1, wherein the first and second springs are received in pockets of flexible material, said pockets of strands of second springs on the opposite borders are glued to the pockets of adjacent spring strands.

7. The innerspring assembly of claim 6, wherein the flexible material is a textile material.

8. The innerspring assembly of claim 1, wherein neighboring rows of spring strands of first springs are mirror images of one another.

9. The innerspring assembly of claim 6, wherein the second springs form a spring strand, said pockets of the spring strand of first springs are separated from one another by first bridges, and said pockets of the spring strand of second springs are separated from one another by second bridges, wherein the first and second bridges are of corresponding length.

* * * * *